United States Patent [19]

Baird

[11] 4,157,252

[45] Jun. 5, 1979

[54] DEVICE FOR FORMING DEMONSTRATION CLEANING-TEST BAGS AND FOR ATTACHING THE SAME TO VACUUM CLEANERS

[76] Inventor: Thomas E. Baird, 2132 N. 24th St., Springfield, Ill. 62702

[21] Appl. No.: 740,762

[22] Filed: Nov. 10, 1976

[51] Int. Cl.[2] ..... B01D 35/02

[52] U.S. Cl. ..... 55/374; 55/274; 55/378; 55/507; 15/339

[58] Field of Search ..... 55/270, 274, 362, 367, 55/369, 374, 378, DIG. 34, DIG. 3, DIG. 5, 498, 500, 503, 505, 507, 509; 15/339; 116/114 AD, DIG. 25; 73/426; 86/20 A; 210/DIG. 23, DIG. 24

[56] References Cited

U.S. PATENT DOCUMENTS

| | | | |
|---|---|---|---|
| 1,075,903 | 10/1913 | Dewey | 86/20 A |
| 2,093,991 | 9/1937 | Boyer | 55/374 |
| 2,315,109 | 3/1943 | Cutter | 210/DIG. 23 |
| 3,203,551 | 8/1965 | Van Loan, Jr. | 55/369 |
| 3,790,986 | 2/1974 | Burger | 15/339 |

*Primary Examiner*—Frank W. Lutter
*Assistant Examiner*—David L. Lacey
*Attorney, Agent, or Firm*—Ralph F. Staubly

[57] ABSTRACT

A device for forming demonstration cleaning-test bags and for attaching them to vacuum cleaners comprises basically a cylindrical tube adapted for placement over the air-discharge port of a sweeper, and a co-operating plunger for pushing the central area of a flexible filter cloth or sheet into the tube. The end of the plunger has fixed thereto a hook-type VELCRO disc for engagement with a co-operating loop-type VELCRO disc cemented or stitched centrally of the filter sheet. Thus the inserted sheet can be turned inside-out to form a bag but after the sheet margin has been anchored to the outer lip surface of the cylindrical tube by a contracting coil-spring band which is rolled thereover from an annular plunger seat encircling said lip. For adjustment to different sizes of bag-forming sheets, the band-holding plunger-seat can be slidable along the plunger, or the plunger body can be length-adjustably formed from telescoping sections. The plunger handle can be of truncated conical shape to hold a plurality of contractable bands. The plunger body is desirably hollow to hold a quantity of sand, salt, etc., for sprinkling onto a rug as a part of the cleaning demonstration. The cylindrical tube alternately can be attached over the air-intake port (after nozzle removal) to demonstrate sweeper suction strength.

10 Claims, 3 Drawing Figures

DEVICE FOR FORMING DEMONSTRATION CLEANING-TEST BAGS AND FOR ATTACHING THE SAME TO VACUUM CLEANERS

BACKGROUND AND OBJECTS OF THE INVENTION

Demonstration cleaning-test bags have previously been manually formed (1) by pushing the center of a filter cloth into the air-outlet port of a vacuum sweeper, (2) by folding the cloth margin over the short port-surrounding tube by which regular bags are connected thereto, and (3) by fastening the folded-over cloth margin by a rubber band or by the coil-spring ring used for regular-bag attachment. This known procedure is not only time consuming but is also unreliable for producing most efficient size of bag for the several variables involved, namely, material of the filter, power of the sweeper, and the kind of floor covering to be operated upon.

It is accordingly the principal object of this invention to provide a device for forming demonstration cleaning-test bags that is easy to operate and is highly reliable for producing the desired size of bag.

It is another object to provide such a device having an internal chamber for holding granular demonstration material.

It is a further object to provide such a device which is easily adjustable for forming different sizes of bags.

It is another object to provide such a device with means for holding a plurality of bag-anchoring contractable bands.

Other objects and advantages will become apparent as the following detailed description proceeds.

SPECIFICATION

Figure 2:
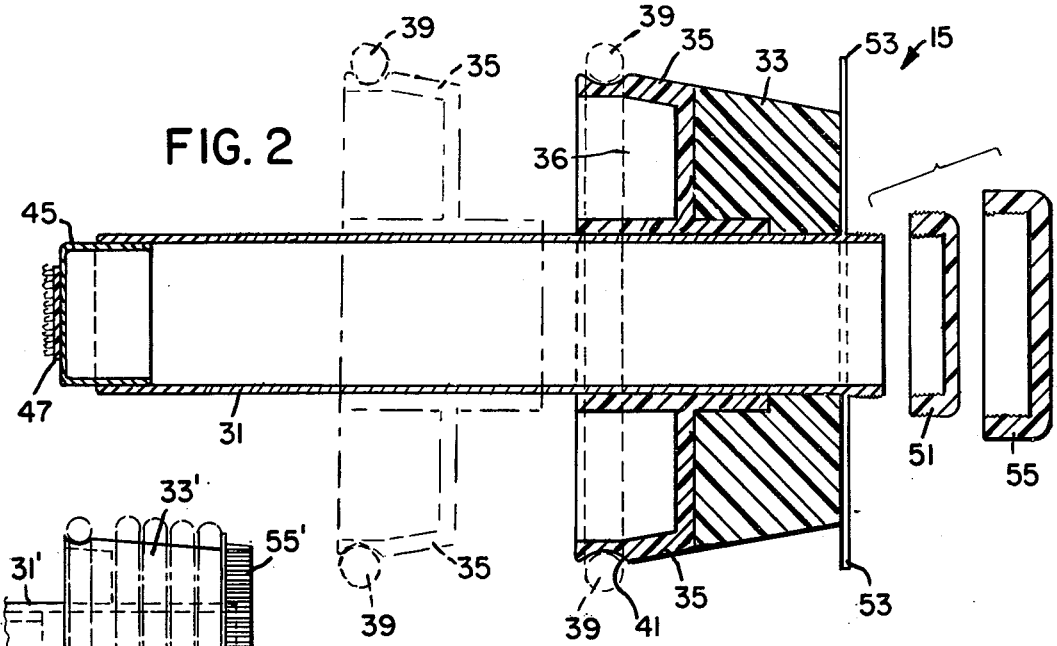
FIG. 2 is a reduced-scale plan view of the filter cloth of FIG. 1.
Figure 1:
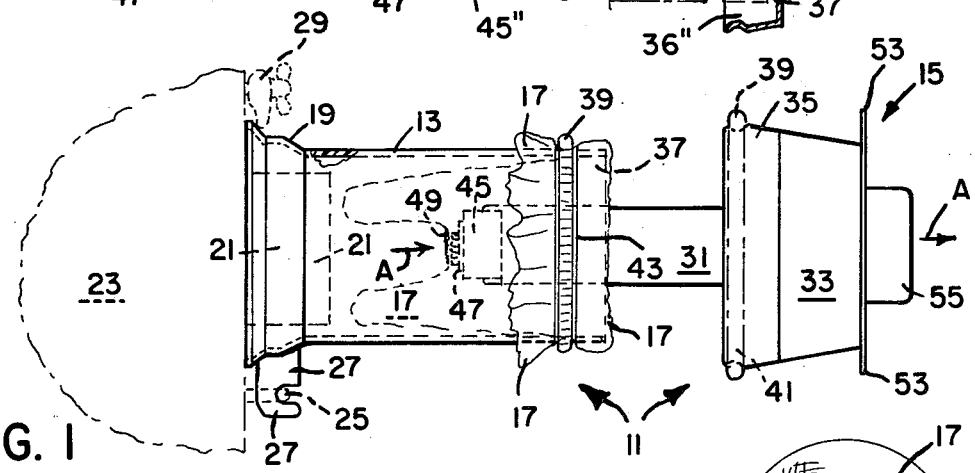
FIG. 1 is a side view of a preferred embodiment of the invention.
Figure 3:
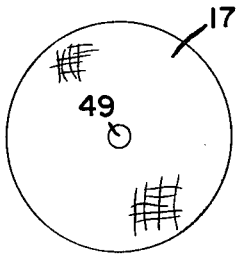
FIG. 3 is an enlarged partly exploded side elevational view of the plunger of FIG. 1 in vertical axial section.

With reference now to FIGS. 1–3 of the drawings, the numeral 11 (FIG. 1) generally designates a preferred embodiment of the invention, which basically comprises a tubular element 13 (FIG. 1), a plunger member 15, and a bag-forming flexible filter lamina 17. The tubular element 13 has a flanged base 19 for fitting over the air-discharge port 21 of a vacuum-sweeper housing 23 (shown in phantom). The housing 23 has a U-shaped rod 25 engageable by hook means 27 on the tubular element 13, and has a latch means 29, which together attach the tubular element 13 to the sweeper being demonstrated. (Here it can be noted that the element 13 can similary be attached to the air-intake port of the sweeper, with its nozzle removed, to demonstrate suction strength.)

Figure 5:
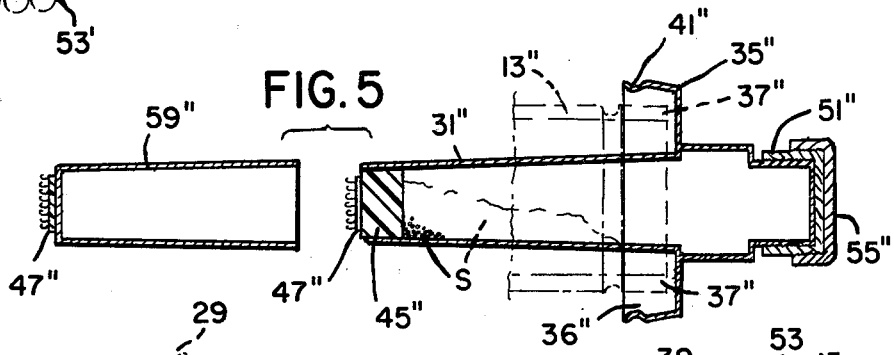
FIG. 5 is a side elevational view of a further modification of the invention in vertical axial section.

The plunger member 15 (best seen in FIG. 2) consists of a metal or plastic tube 31 to which is fixed a plastic knob or handle 33 and on which is slidably mounted a plastic member 35. The member 35 has an open-faced annular channel 36 which embraces the lip 37 of the tubular element 13 when the plunger is pushed fully thereinto (as shown in FIG. 5). This permits a stretched coil-spring band 39 to be rolled off the seat 41 onto the margin of the filter element 17 (FIG. 1) after the latter has been inserted deeply into the tubular element 13 and its margin has been turned forwardly over the lip 37. The band 39 is transferred while the plunger and the tube are in their relative positions shown in FIG. 5. The tubular element 13 has a band-retaining annular groove 43.

The tube 31 of the plunger 15 has its front end closed by a hollow plug 45 threadedly connected thereto. The plug 45 has cemented to its front face a hook-type VELCRO disc 47 which is adapted to grip a loop-type VELCRO disc 49 cemented or stitched to the center of the filter lamina 17. The plug 45 is removable to permit the tube 31 to be filled with sand or salt S, etc. (FIG. 5), for sprinkling onto rugs during demonstrations. The handle end of the tube 31 projects from the knob 33 and is threaded to receive a perforated salt-shaker-type cap 51, which also serves to clamp a centrally apertured spring-band-retaining disc 53 against the knob 33. The shaker cap 51 is covered by a threaded (or press-fitted) cap 55.

Figure 4:
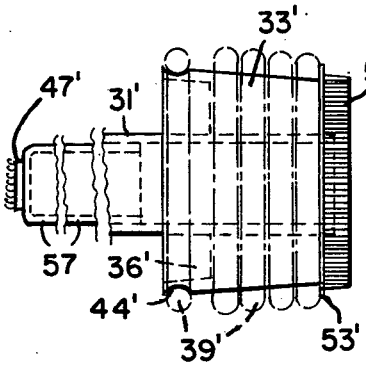
FIG. 4 is a side elevational view of a telescopic-plunger species of the invention.

In the species of FIG. 4, primed numerals indicate parts corresponding to those designated by unprimed numerals in FIGS. 1 and 2, while the numeral 57 indicates an added tube that telescopes into the tube 31' for variable distances to vary the size of the bag being formed.

In FIG. 5 double-primed numerals indicate parts corresponding to those designated by unprimed numerals in FIGS. 1 and 2. But in FIG. 5 the tube 31" is tapered slightly to receive over its tip a similarly tapered extension sleeve 59" to lengthen the plunger for forming larger test bags. The extension sleeve 59" also has a VELCRO disc 47" fixed to its end. Different-length extension sleeves can be selectively used.

In FIG. 1 the plunger member 15 is shown as being halfway withdrawn (note axial arrows A) and as beginning to turn the bag lamina 17 inside-out.

The invention having been described, what is claimed as new and patentable is:

1. A device for forming a demonstration cleaning-test bag and for attaching it to a vacuum sweeper, comprising: an elongated tubular element including means for attaching one end thereof sealingly to the air-discharge port of a vacuum cleaner, an elongated plunger member insertable axially into the other end of said tubular element for pushing the center of a flexible filter lamina into said tubular element, said plunger having an annular portion of a diameter greater than the diameter of said tubular element and having a circumferentially disposed seat for holding a stretched band positioned for axial movement therefrom over and onto the margin of a filter lamina, when said lamina is folded forwardly over said other end of said tubular element prior to plunger withdrawal, to anchor the bag thus-formed to said tubular element.

2. A device according to claim 1, said annular portion additionally including radially extending stop means for engaging said other end of said tubular element to limit plunger penetration.

3. A device according to claim 2, said annular portion being slidable along said plunger to adjust said device for forming bags of different sizes.

4. A device according to claim 1, said other end of said tubular element having a circumferential groove near its end to form a band-retaining seat.

5. A device according to claim 1, said plunger member additionally comprising a truncated-conical handle portion for holding a plurality of said stretched bands behind said seat for sequential use.

6. A device according to claim 1, said plunger member being hollow to hold a quantity of granular demonstration material.

7. A device according to claim 6 and additionally comprising a perforated shaker-type member partially closing the chamber in said plunger, and a sealing cover for said perforated member.

8. A device according to claim 1, said plunger comprising a plurality of telescoping tubes for length adjustment.

9. A device according to claim 1, wherein the forward end of said plunger has a quickly engageable-and-detachable means for gripping the center of a filter lamina to facilitate its insertion into and its subsequent withdrawal from said tubular element.

10. A device according to claim 9, said last-mentioned means being a piece of hook-type tape for engagement with a piece of loop-type tape fastened to the center of a filter lamina.

* * * * *